United States Patent [19]

Cairns et al.

[11] 4,343,523

[45] Aug. 10, 1982

[54] PRINTED CIRCUIT BOARD EDGE CONNECTOR

[75] Inventors: Thomas M. Cairns, Birmingham; David G. Connors, Canton, both of Mich.

[73] Assignee: Ford Motor Company, Dearborn, Mich.

[21] Appl. No.: 153,812

[22] Filed: May 27, 1980

[51] Int. Cl.[3] ..... H01R 13/40

[52] U.S. Cl. ..... 339/59 M; 339/176 MP; 339/259 R

[58] Field of Search ..... 339/59 R, 59 M, 176 MP, 339/217 R, 259

[56] References Cited

U.S. PATENT DOCUMENTS

| | | | |
|---|---|---|---|
| 3,155,446 | 11/1964 | Kowaleski et al. | 339/176 MP |
| 3,193,791 | 7/1965 | Bock et al. | 339/176 MP |
| 3,475,717 | 10/1969 | Lane | 339/176 MP |
| 3,686,619 | 8/1972 | McCardell, Jr. et al. | 339/217 R |
| 4,046,444 | 9/1977 | Brorein | 339/176 MP |

*Primary Examiner*—Joseph H. McGlynn

*Attorney, Agent, or Firm*—Peter Abolins; Robert D. Sanborn

[57] ABSTRACT

This specification discloses a connector for coupling to the edge of a printed circuit board. The connector contains terminals which are staggered in the direction of insertion of the printed circuit board into the connector. Such staggering reduces the peak magnitude of the insertion force. A securing spacer in the connector prevents undesired motion by the terminal and prevents partial insertion of the terminal into the connector.

5 Claims, 12 Drawing Figures

PRINTED CIRCUIT BOARD EDGE CONNECTOR

BACKGROUND OF THE INVENTION (1) Field of the Invention

This invention relates to a contact structure; and, in particular, to a contact terminal for use as an edge connector for a printed circuit board.

(2) Disclosure Statement

There are known various snap-in contact structures for use as an edge connector to a printed circuit board or other conductor equipped panels. Such a connector is ordinarily an elongated structure with a body part formed of an insulating material having a longitudinally extending slot or channel along one side to receive an edge portion of a printed circuit board. The insulating body part also receives a plurality of conductive terminals for making contact with conductive strips on the printed circuit board. The terminals are disposed in longitudinally spaced relation along the slot and isolated electrically from each other.

When a conductor equipped panel is inserted into the connector, the contact terminals engage and thereby make electric connections with the conductors of the panel. Each of the contact structures is connected individually to one of a plurality of lead wires. Such connection can be made before the terminals are mounted within the insulating body part. A common arrangement for establishing an interconnection between the terminals and connector body requires the terminals to be compressed or otherwise momentarily distorted during insertion thereof into the connector body. It has been found that such distortion (beyond the residual distortion after complete connection) of the contacts, although momentary, can be sufficient to give the contact a permanent set which tends to destroy the essential resilience thereof that assures the frictional grip of the contact with the aligned conductor of a panel inserted into the connector.

It is also recognized that providing an appropriate contact pressure or spring tension for the terminal can be difficult. A high contact pressure is desirable to maintain a good electrical connection between the terminal and the conductive strip on the printed circuit board. However, a relatively high contact force has a tendency to damage the conductive strips on a printed circuit board thereby causing a circuit discontinuity or limiting the number of circuit board insertions and removals without damage.

On the other hand, a relatively low terminal mating or engagement force is desirable to facilitate easy insertion of the printed circuit board into the connector. That is, a large number of terminals in the connector can make insertion of the printed circuit board into the connector a difficult task. If the connector has but one spring contact, the resistive force exerted thereby on a printed circuit board inserted into the connector is not sufficiently large that it creates a problem. However, if the connector has a plurality of contacts oriented in a row so that each such contact resists insertion of a single printed circuit board into the connector, the cumulative forces make initial insertion of the printed circuit board quite difficult. This is the situation with an edge connector for a printed circuit board which is equipped with a plurality of conductors each adapted to be connected to one spring contact. Further, during assembly of the contact structure, it is desirable that the conductive terminals can be easily and quickly inserted into the connector and secured in a fully inserted position.

Many known terminals for use with printed circuit boards are undesirably large for use in current automotive applications, where smaller and lighter components are being sought. Placing such terminals side by side produces an undesirably large printed circuit board and requires a larger connector. An attempt at simple downsizing of the terminal may produce a terminal with insufficient contact pressure and attendant electrical discontinuity, unreliability and customer dissatisfaction.

Among the known terminals are those which have a contact spring pivoting at the forward end of the terminal. Thus, the electrical contact point between the contact spring and the conducting strip is rearward of the spring pivot point at the forward part of the terminal. Such rearward positioning of the contact point requires a longer printed circuit board ledge than would be required if the contact point were positioned closer to the forward portion of the terminal. As can be appreciated, a longer printed circuit board edge increases the weight and size of the circuit board assembly. These are some of the problems this invention overcomes.

SUMMARY OF THE DISCLOSURE

This disclosure teaches a coupling means for the edge of a printed circuit board wherein electrical connection is established with a conductive portions on a printed circuit board inserted into the connector so that the forces resisting insertion are successively applied thereby distributing the insertion force and reducing the peak insertion force.

The printed circuit board edge coupling means includes a connector and a plurality of terminals. The connector includes at transversely extending contact receiving slot cavity across the width of the connector. The cavity is adapted to receive the conductive portions at the edge of the printed circuit board. The cavity has a pair of spaced apart and generally parallel facing walls. The terminals are positioned adjacent the walls on a side opposite the cavity. The walls have a plurality of contact openings for passing a portion of the terminals so that the terminals can have access to the conductor portions on the printed circuit board inserted into the cavity. Pairs of the openings are generally opposed to one another, located at the same longitudinal position along the slot cavity and staggered in a transverse direction parallel to the direction of insertion of the printed circuit board into the slot cavity so that insertions of the printed circuit board edge successively engages the two terminals of the pair. Such staggering of the position of engagement between the printed circuit board and the terminals reduces the magnitude of the peak force during insertion of the printed circuit board. Such staggering of the terminals also prevents generally opposing terminals from shorting one another. In view of these features, this invention provides a compact coupling means which can provide a plurality of electrical connections to both sides of a printed circuit board. At the same time, the printed circuit board is relatively easily inserted into the coupling means and the terminals are easily and positively secured in the connector.

DESCRIPTION OF THE PRESENTLY PREFERRED EMBODIMENT

Figure 1:
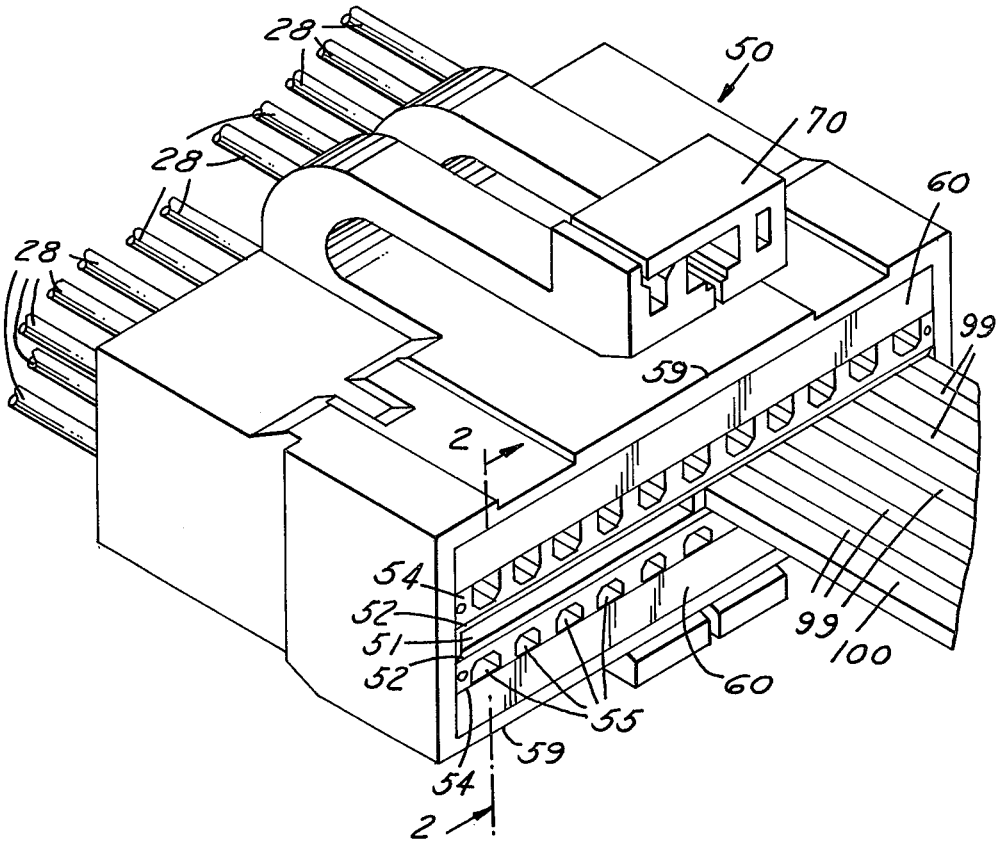
FIG. 1 is a perspective view of a connector which houses terminals connected to lead wires in accordance with an embodiment of this invention.
Figure 8:
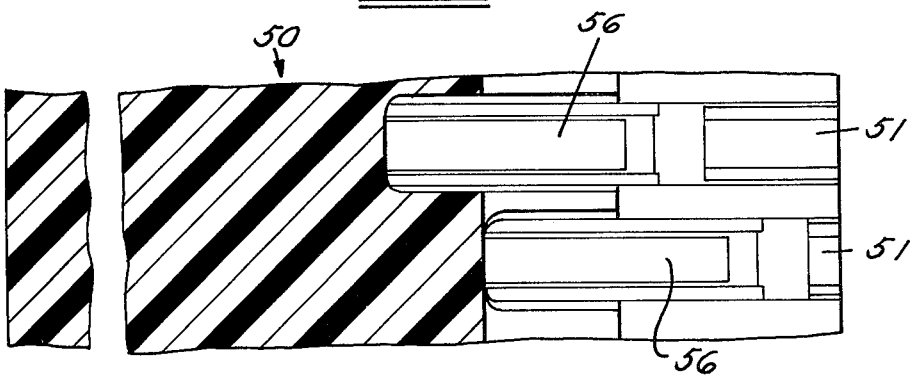
FIG. 8 is a view generally taken along line 8—8 of FIG. 4.
Figure 2:
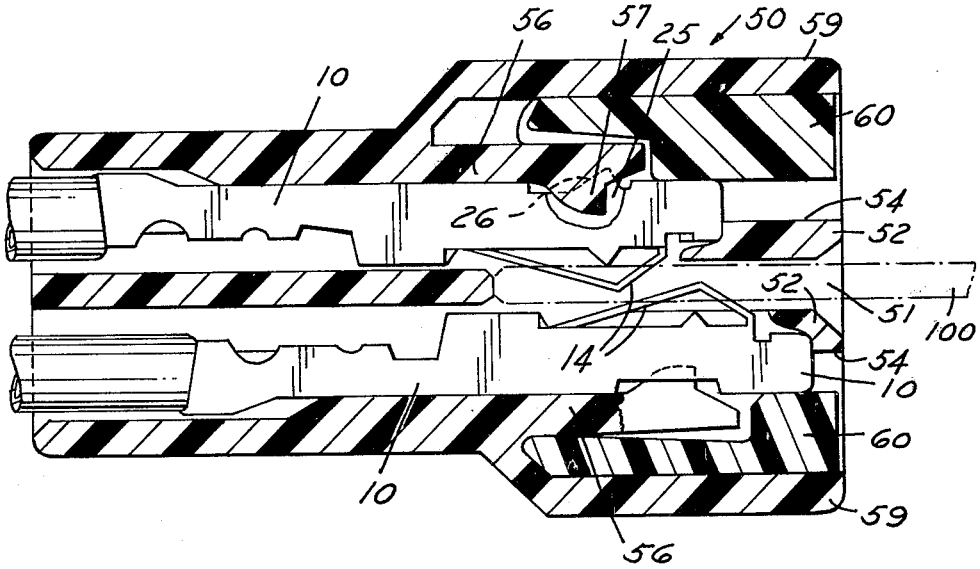
FIG. 2 is a partly section view taken generally along section line 2—2 of FIG. 1 with the terminals not sectioned.
Figure 4:
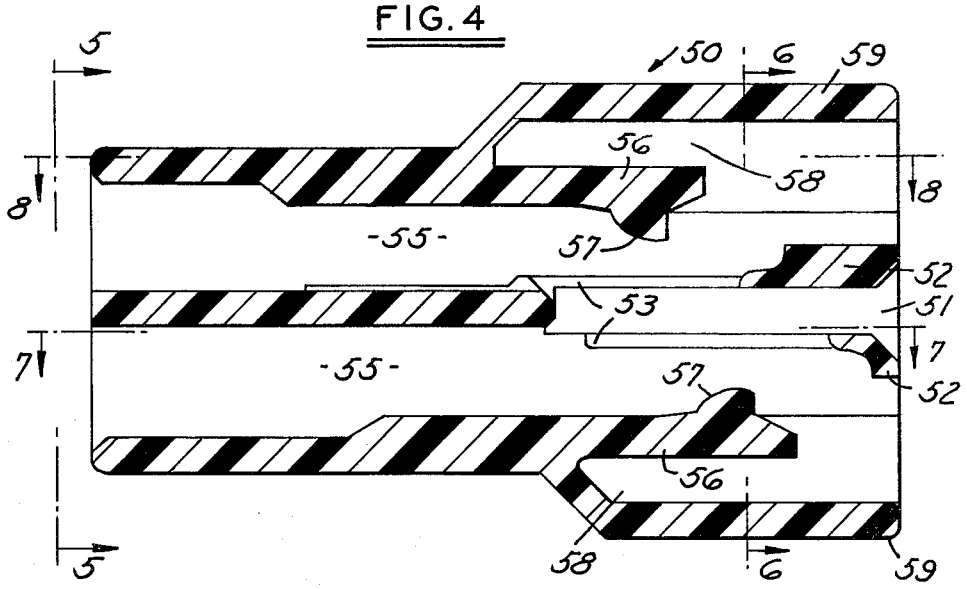
FIG. 4 is a view similar to FIG. 2 without the terminal and the spacer inserted.
Figure 5:
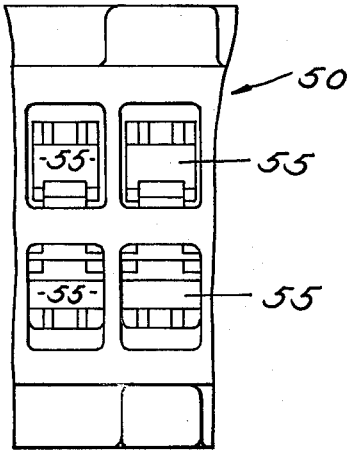
FIG. 5 is a view taken generally along line 5—5 of FIG. 4.
Figure 6:
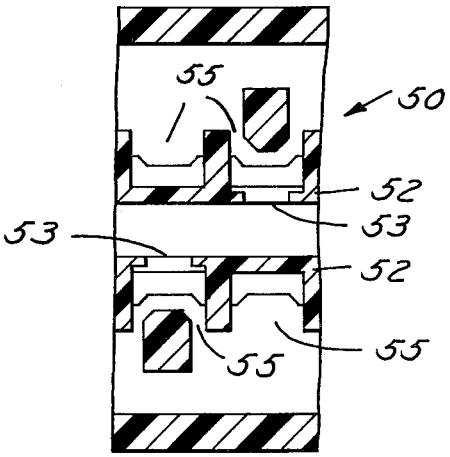
FIG. 6 is a view generally taken along line 6—6 of FIG. 4.
Figure 7:
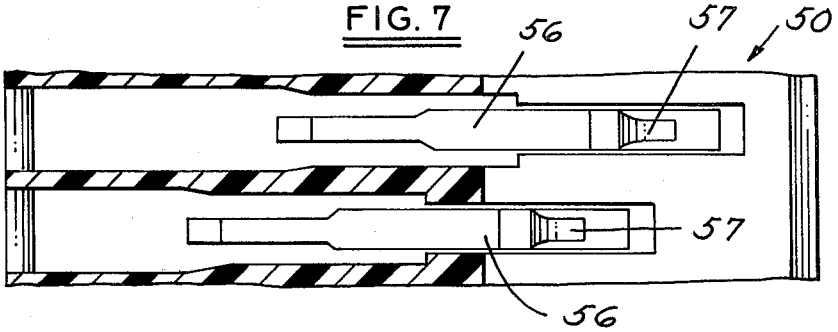
FIG. 7 is a view generally taken along line 7—7 of FIG. 4.

Referring to FIGS. 1 and 2, a plurality of generally elongated terminals 10 for contacting a conducting strip 99 at the edge of a printed circuit board 100 are positioned in a connector 50 which receives, in a slot 51, an edge of printed circuit board 100. Slot 51 is bounded by a pair of walls 52 which each have a plurality of side-by-side troughs 55 formed therein for receiving terminals 10. Troughs 55 are aligned in the direction insertion of circuit board 100 into slot 51. Contact openings 53 (FIGS. 4 and 6) in walls 52 permit a terminal 10 positioned in trough 55 to contact a conducting strip 99 on an inserted circuit board 100.

Referring to FIGS. 9–12, terminal 10 includes a rear portion 20 from which extend forward a pair of opposing, elongated, generally rectangular spaced side members 13. An elongated, curved contact spring 14 is coupled to the rear portions of side members 13 at an upper edge 21. An elongated, curved secondary spring 15 is coupled to the rear portions of side members 13 at a lower edge 22. Secondary spring 15 is biased toward contact spring 14 and supplies a force resisting deflection of contact spring 14. Front portions 23 of side members 13 are connected by a nose clamp 16 which extends over the forwardmost portion of contact spring 14 and pre-loads contact spring 14 and secondary spring 15. Initial deflection of contact spring 14 in a pre-loaded condition produces a greater contact pressure than if contact spring 14 were not pre-loaded.

Figure 9:
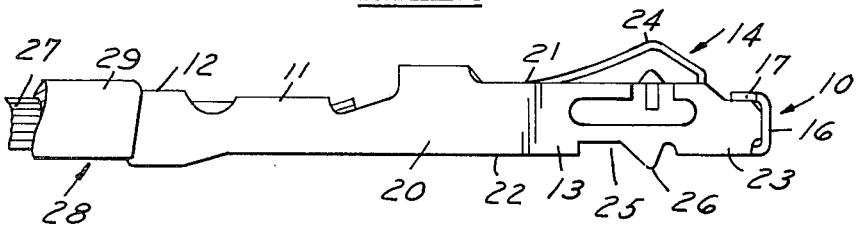
FIG. 9 is a side elevation view of a terminal in accordance with an embodiment of this invention.
Figure 11:
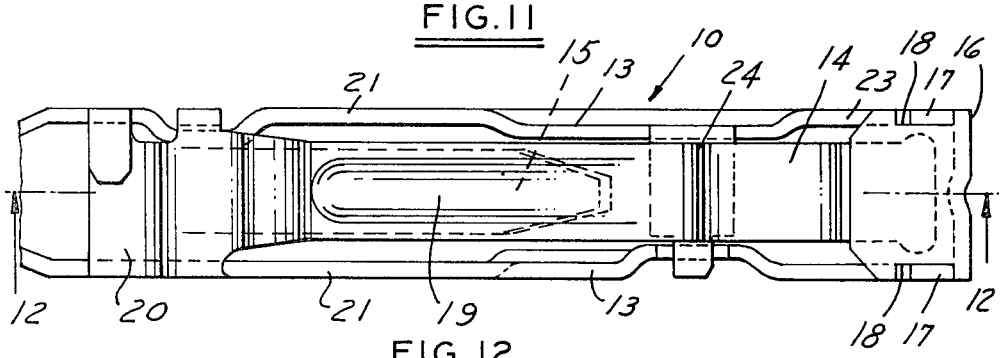
FIG. 11 is a top plan view of a portion of the terminal shown in FIG. 9.

To prevent accidental deflection of nose clamp 16 off the forwardmost portion of contact spring 14, a pair of tabs 17 extend upward from front portions 23 of side members 13 and are positioned in a pair of cooperating indentations 18 extending into the sides of nose clamp 16 thereby preventing forward motion of nose clamp 16 (FIGS. 9 and 11). Such securing of nose clamp 16 and by tabs 17 and indentations 18 is particularly advantageous when terminal 10 is unintentionally inserted upside down into connector 50 and must be removed. When no such retention is provided, removal of terminal 10 may deflect nose clamp 16 thereby freeing the forwardmost portion of contact spring 14 and causing contact spring 14 to pop up (See FIG. 12 dotted outline).

Referring to FIG. 11, contact spring 14 has a generally slight taper of decreasing width from the rear to the front of terminal 10. Additionally, contact spring 14 includes a bead or groove 19 which tapers or decreases in width from the front to the rear of terminal 10. The tapers, although in opposite directions, increase the strength of contact spring 14 adjacent the pivot point adjacent rear portion 20 of side member 13. The stress distribution on contact spring 14 is not uniform and tends to concentrate near the pivot point. To reduce unnecessary size and weight of contact spring 14 it is desirable to remove any material unnecessary for strength. As a result, the tapered width of terminal 10 and of bead 19 changes the section modulus of contact spring 14 to produce a constant stress in contact spring 14.

Secondary spring 15 is also tapered with the width decreasing from the rear to the front of terminal 10. As with contact spring 14, bending of secondary spring 15 produces a stress which increases toward the pivot point near rear portion 20. Accordingly, since the weight and size of secondary spring 18 can be minimized when stress is equalized throughout the secondary spring 15, less material is required near the forward end of secondary spring 15 than the rear of secondary spring 15.

Figure 12:
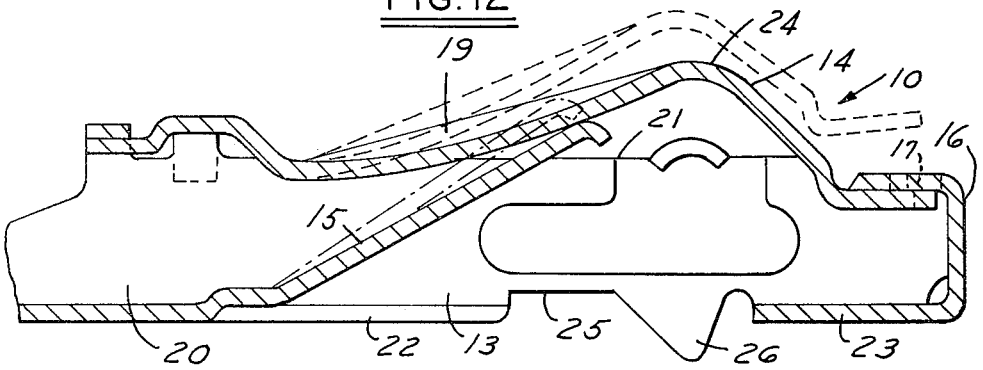
FIG. 12 is a section view along line 12—12 of FIG. 11.

Referring to FIG. 12, contact spring 14 and secondary spring 15 are shown in unloaded condition in dotted outline. FIG. 12 in full outline shows contact spring 14 and secondary spring 15 in a pre-loaded condition as positioned by nose clamp 16. Pre-loading permits a higher contact force to be applied by contact spring 14 while at the same time reducing the amount of travel required of contact spring 14 to obtain the desired force.

Reducing the travel of the spring is desirable because it permits close positioning of opposing terminals. Such positioning is desirable, for example, when contact is desired to be made to directly opposing sides of a printed circuit board. FIG. 2 shows that opposing contact springs 14 of opposing terminals 10 do not touch even when circuit board 100 is not inserted. The position circuit board, as would occupy if inserted is shown in dotted outline.

Figure 10:
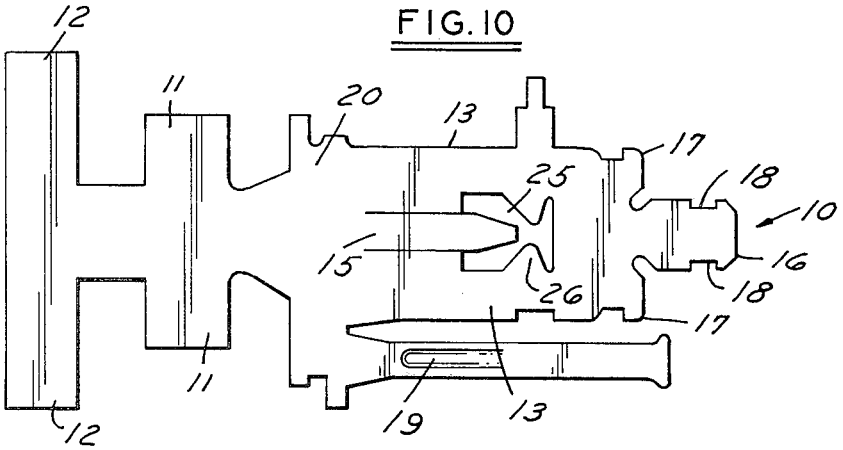
FIG. 10 is a plan view of a blank appropriate for forming a terminal in accordance with an embodiment of this invention.

Terminal 10 also includes an opening 25 between lower edges 22 of side members 13 for locking to connector 50 by receiving a protrusion 57 of a resilient securing finger 56 (FIG. 2). A pair of tangs 26 extend downward from lower side 22 outside member 13 adjacent opening 25. These tangs serve to guide terminal 10 on resilient finger 56 during insertion of a terminal 10 into a trough 55. Terminal 10 also includes a pair of forward prongs 11 and a pair of rear prongs 12 extending from rear portion 20. Forward prongs 11 are generally opposing and are crimped over to contact a center conductor 27 of a lead wire 27. Rear prongs 12 are also opposing and are crimped over to receive insulation 29 around center conductor 27 of lead wire 28 (FIGS. 9 and 10).

Figure 3:
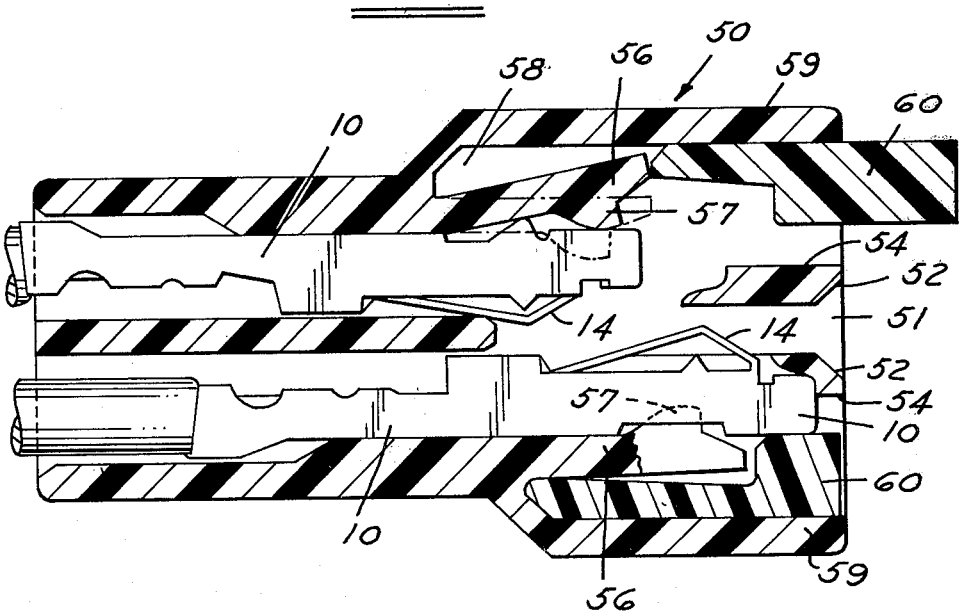
FIG. 3 is a view similar to FIG. 1 with the terminal partly inserted into the connector so that the resilient fingers are deflected and prevents the spacer from properly seating.

Referring to FIGS. 1 and 3, a connector 50 includes a slot 51 extending the width, and a portion of the depth, of connector 50 and bounded by opposing walls 52. Each of opposing walls 52 has a plurality of generally rectangular contact openings 53 for exposing a terminal 10 through wall 52. Adjacent contact openings 53 are staggered in a forward and rear direction so that insertion of the edge of printed board successfully, rather than simultaneously, deflects contact springs 14 of terminals 10 thus reducing insertion. Additionally, generally opposing contact openings 53 at the same position along the width of slot 51 are staggered in a forward and rear direction so that contact can be made to a printed board edge on opposite sides without undesirable shorting between opposing terminals 10 when printed circuit board 100 is removed from connector 50.

Outside surfaces 54 of opposing walls 52 face away from slot 51 and contain a plurality of elongated, parallel troughs 55 for receiving a terminal 10. The open long side of trough 55 has extending therealong resilient finger 56 with protrusion 57 which engages opening 25 of terminal 10. The bottom of each trough 55 includes one contact opening 53 which provides access to slot 51.

A pair of outside walls 59 are spaced from walls 52 and face outside surfaces 54 of walls 52. A pair of longitudinal spaces 58 between walls 52 and outside walls 59 each receive an elongated spacer 60. When terminal 10 is inserted into trough 55 and resilient finger 56 engages opening 25, spacer 60 fits snuggly into adjacent space 58 thereby preventing excessive play in terminal 10 or movement of resilient finger 56. Spacer 60 can be held within connector 50 by, for example, a ridge in connector 50 which engages a slot in spacer 60. As shown in FIG. 3, the use of spacer 60 prevents partial insertion of terminal 10 wherein resilient finger is deflected upward but does not engage opening 25. That is, with resilient finger 56 deflected upward, spacer 60 is blocked from completely entering space 58.

Connector 50 also includes a locking arm 70 (FIG. 1) which engages a ramp (not shown) to firmly secure connector 50 to a mounting member. This provides mechanical attachment of connector 50.

Various modifications and variations will no doubt occur to those skilled in the various arts to which this invention pertains. For example, the particular number of terminals in a connector may be varied from that disclosed herein. These and all other variations which basically rely on the teachings through which this disclosure has advanced the art are properly considered within the scope of this invention.

We claim:

1. A printed circuit board edge coupling means for connecting to conductor portions of a printed circuit board, said coupling means including a connector and a plurality of terminals;

said connector including a contact receiving slot cavity with an entrance extending across the width of said connector, said cavity being adapted to receive the conductive portions at the edge of a printed circuit board, said cavity having a pair of spaced apart walls extending parallel to the plane of insertion of the printed circuit board into said coupling means;

said terminals being positioned along said cavity adjacent said walls on sides opposite from said cavity;

said walls having a plurality of contact openings for passing a portion of said terminals so that said terminals can have access to the conductor portions on a printed circuit board inserted into said cavity, pairs of said openings being generally opposed along said slot cavity and staggered forward and rearward in a direction parallel to the direction of insertion of the printed circuit board into said slot cavity so that insertion of a printed circuit board edge successively engages each one of a pair of said terminals at the same longitudinal position thus reducing the magnitude of the peak force during insertion of the printed circuit board, and preventing generally opposing terminals from shorting;

adjacent contact openings in the same wall also being staggered forward and rearward in a direction parallel to the direction of insertion of the printed circuit board into said slot cavity so that said printed circuit board is centered between said spaced apart walls as said printed circuit board is inserted, first by portions of said terminals extending through a first group of contact openings nearest said entrance and then by portions of said terminals extending through a second group of contact openings furthest from said entrance;

said walls having a plurality of aligned troughs for receiving said terminals;

said troughs having a generally U-shaped cross section with an open side and being formed on the sides of said walls opposite from said cavity;

one of said plurality of openings being associated with each trough to provide communication through said wall between a trough and said cavity; and removable securing means positioned at the open sides of said troughs for at least partially securing said terminals thereby preventing undesired motion of said terminals, and for providing a supporting surface across said troughs to support said terminals and limit movement of said terminals away from said slot cavity when the printed circuit board is inserted into said slot cavity.

2. A printed circuit board edge coupling means as recited in claim 1 further comprising:

a plurality of elongated resilient fingers, each finger positioned generally parallel to one of said troughs at the open side of a trough, each of said resilient fingers having a protrusion for engaging one of said terminals when it is positioned in one of said troughs, said securing means being barred from complete entry into said connector when said terminals are not fully inserted into said connector and a finger is deflected by a terminal thus blocking insertion of said securing means.

3. A printed circuit board edge coupling means as recited in claim 2 wherein said securing means is an elongated spacer adapted to fit snugly in a space bounded by an outer shell of said connector and said resilient fingers, said spacer extending substantially the length of said cavity.

4. A printed circuit board edge coupling means as recited in claim 3 wherein the contact openings in said first group and said second group have the same size and shape as others in the group; and said contact openings of said first and second groups all having a common rearwardmost boundary, and said contact openings in said first group having a leading edge positioned forward of the leading edge of the contact openings in said second group.

5. A printed circuit board edge coupling means as recited in claim 4 wherein said coupling means includes a terminal comprising:

a pair of spaced, generally parallel elongated side members having a front end and back end;

first spring means coupled to the back end of said side members adjacent a pivot point, said first spring means having an outside portion for contacting a conductive portion of the printed circuit board, so that contact to the conductive portion is forward of said pivot point;

a second spring means coupled to the back end of said side members for contacting said first spring means on a side opposite from said outside portion contacting the conductive portion, so that the combination of said first and second spring means produces a higher contact force with improved reliability;

a nose clamp means for preloading said first spring means to a deflected and stressed position so that said first spring means is in a partially compressed state thus providing a higher initial contact pressure between said terminal and the conductive portion; and wherein said first and second spring means are positioned so that when said first spring means is in a preloaded condition, said second spring means is also in a preloaded condition and applies a reinforcing contact pressure to said first spring means.

* * * * *